US009770062B1

(12) United States Patent
Armetta

(10) Patent No.: US 9,770,062 B1
(45) Date of Patent: Sep. 26, 2017

(54) PROTECTIVE AND INSULATING FOOTWEAR COVER

(71) Applicant: David Armetta, Stamford, CT (US)

(72) Inventor: David Armetta, Stamford, CT (US)

( * ) Notice: Subject to any disclaimer, the term of this patent is extended or adjusted under 35 U.S.C. 154(b) by 0 days.

(21) Appl. No.: 15/068,628

(22) Filed: Mar. 13, 2016

Related U.S. Application Data

(60) Provisional application No. 62/131,870, filed on Mar. 12, 2015.

(51) Int. Cl.

| | |
|---|---|
| ***A43B 5/18*** | (2006.01) |
| ***A43B 3/18*** | (2006.01) |
| ***A43B 3/00*** | (2006.01) |
| ***A43B 23/24*** | (2006.01) |
| ***A43B 3/20*** | (2006.01) |

(52) U.S. Cl.
CPC ..... *A43B 3/18* (2013.01); *A43B 3/0031* (2013.01); *A43B 3/20* (2013.01); *A43B 5/18* (2013.01); *A43B 23/24* (2013.01)

(58) Field of Classification Search
CPC .... A43B 3/16; A43B 3/20; A43B 3/24; A43B 3/242; A43B 5/18; A43B 23/24
USPC ..... 36/100, 101, 7.1 R, 7.2, 72 R
See application file for complete search history.

(56) References Cited

U.S. PATENT DOCUMENTS 2,657,477 A * 11/1953 Winslow ..... A43B 3/20 36/140
3,250,025 A * 5/1966 Crescent ..... A43B 3/16 36/72 R
4,445,287 A * 5/1984 Garcia ..... A43B 5/1666 36/106
5,272,822 A * 12/1993 Diaz ..... A41D 17/00 36/2 R
5,566,476 A * 10/1996 Bertrand ..... A43B 5/18 36/72 R
5,829,170 A * 11/1998 Lutz, Jr. ..... A43B 5/1683 36/7.1 R
5,987,778 A * 11/1999 Stoner ..... A41D 17/00 36/1.5
6,038,792 A * 3/2000 Hauter ..... A43B 5/02 36/133
6,854,200 B2 * 2/2005 Hipp ..... A43B 3/20 280/811
7,908,771 B2 * 3/2011 Foxen ..... A43B 7/20 36/100
8,689,469 B2 * 4/2014 Foxen ..... A43B 5/18 36/100
2002/0066208 A1 * 6/2002 Hall ..... A43B 3/0078 36/7.3
2003/0196351 A1 * 10/2003 Hipp ..... A43B 3/20 36/72 R
2005/0044750 A1 * 3/2005 Marchese ..... A43B 1/0081 36/72 R (Continued)

*Primary Examiner* — Marie Bays
(74) *Attorney, Agent, or Firm* — Shifrin Patent Law; Dan Shifrin

(57) ABSTRACT

Embodiments of the present invention provide a cover that wraps over footwear and is secured in place with a set of attachment tabs wrapped under the arch area of the footwear and secured to each other. Another attachment tab wraps over the arch area and is secured to a corresponding attachment point on the outer surface of the cover. Depending on the material used, once the cover is secured in place, it may provide insulation and abrasion resistance.

7 Claims, 6 Drawing Sheets

(56) References Cited

U.S. PATENT DOCUMENTS

| | | | | |
|---|---|---|---|---|
| 2007/0186449 | A1* | 8/2007 | Wilcots | A41D 17/00 36/2 R |
| 2009/0071037 | A1* | 3/2009 | Foxen | A43B 7/20 36/89 |

* cited by examiner

PROTECTIVE AND INSULATING FOOTWEAR COVER

RELATED APPLICATION DATA

The present application is related to and claims the benefit of commonly-owned and U.S. Provisional Application Ser. No. 62/131,870, entitled SYSTEM, METHOD AND DEVICE FOR PROTECTING AND INSULATING FOOTWEAR, filed on Mar. 12, 2015, which application is incorporated herein by reference in its entirety. The present application is also related to commonly-owned United States Design Application Serial Number 29/523723, entitled FOOTWEAR COVERING, filed on Apr. 13, 2015, which application is incorporated herein by reference in its entirety.

TECHNICAL FIELD

The invention relates generally to providing and using a device that covers footwear after the footwear is already being worn, that protects and insulates the footwear in order to increase it's utility in certain conditions as well as allowing for more efficient use of said footwear. More specifically, the invention relates to the configuration of, and use of specific types of materials and designs of the device that allow ease of application and the use of these novel footwear covers.

BACKGROUND ART

Features of the prior art and of the current invention are described herein primarily with respect to use as applied to ice skates for purposes of descriptive clarity. However, many or all of these features are also applicable to other sports shoes, such as but not limited to roller blades, ski boots, snowboard boots, hiking shoes, mountaineering boots, climbing shoes, hunting boots, show shoes, certain work shoes, and the like. It is understood that the general concept and configuration of the present invention are useful in other footwear.

Traditionally, ice skates present several issues: First, ice skates are comprised of a boot and a blade that is attached to the bottom of the boot that allows the skater to move along ice. Because ice skating is a sport that only takes place on ice, it exposes the skater for prolonged periods of time to cold temperatures. The boots generally get cold causing the skaters feet to become cold with results ranging from simply uncomfortable to becoming dangerously cold, including experiencing frostbite.

Second, in addition to cold temperatures, ice skate boots are generally subjected to damage by sharp skate blades and other parts of ice skate boots. This damage can be caused by both the ice skater themselves or other ice skaters. Damaged boots can have ramifications to the ice skater ranging from a breakdown of the skate boot requiring replacement of the boot, to a skater being penalized during competitions for damaged, and unsightly skates.

Also, ice skating generally requires the practicing skater to repeat the same movements many times before they are able to perform the movement correctly. While the skater is still learning those movements, the skater's boots are impacted negatively due to incorrect placement of the skates and blades. This results in damaged boots that are very costly to replace and require long break-in periods for the skater.

In addition, figure skates are often covered by adhesive tape during competitions to hide blemishes on the skates. It would seem that a simple alternative is to have two pairs of skates . . . one for practice and one for competition. There is an inherent problem with that concept due to the individual feel of each skate to the skater. Few skaters, if any, will risk the outcome of a competition to unfamiliar equipment. Also, obtaining and maintaining two sets of skates is potentially financially prohibitive.

Similarly, footwear used for other specific activities is very often subjected to outside elements that are beyond the original footwear's design parameters.

SUMMARY OF THE INVENTION

Embodiments of the present invention provide a cover that wraps over footwear and is secured in place with a set of attachment tabs wrapped under the arch area of the footwear and secured to each other. Another attachment tab wraps over the arch area and is secured to a corresponding attachment point on the outer surface of the cover. Depending on the material used, once the cover is secured in place, it may provide insulation and abrasion resistance.

DETAILED DESCRIPTION OF THE PREFERRED EMBODIMENT

Figure 1:
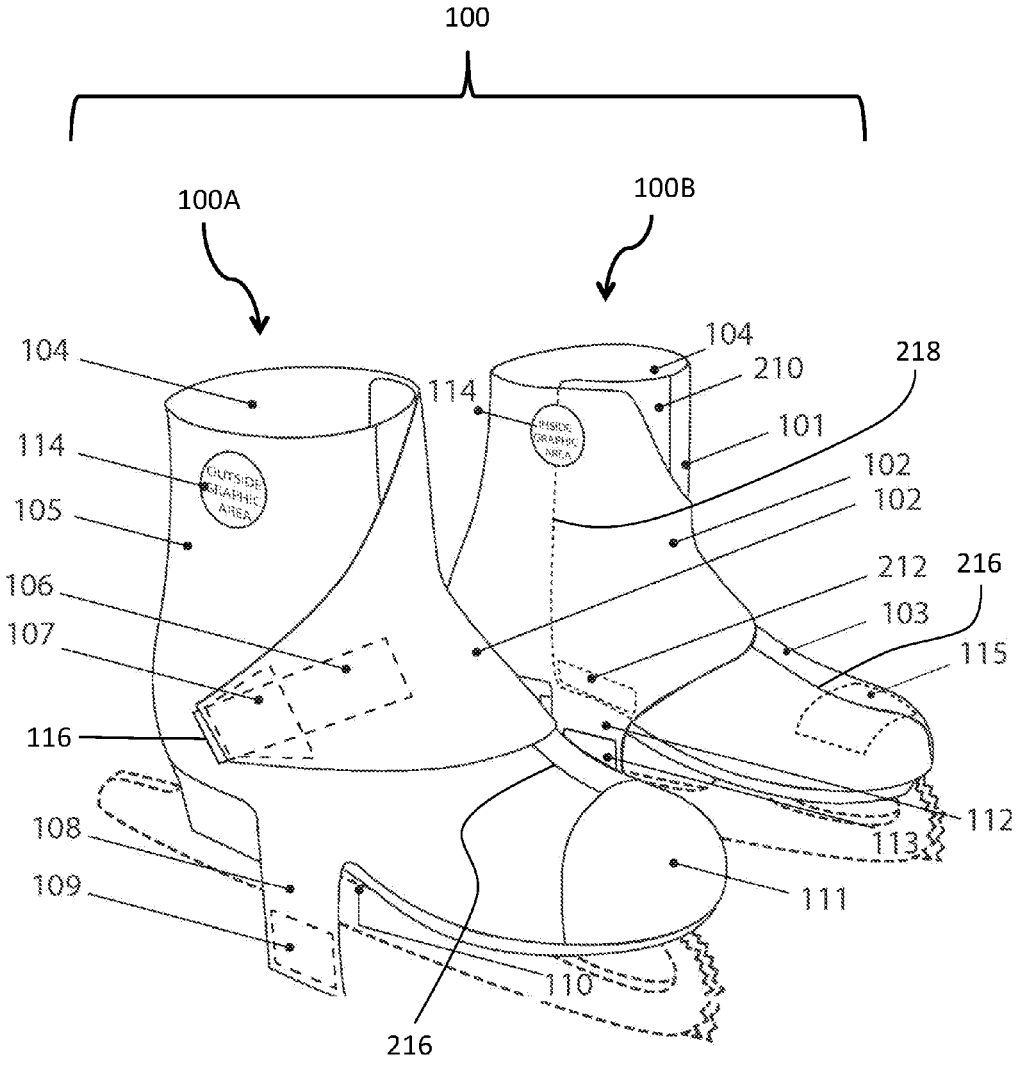
FIG. 1 illustrates an embodiment of footwear covers of the present invention wrapped on a pair of ice skates.

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

This invention overcomes several disadvantages of the prior art by providing a device for sport footwear, such as a skating boot, that includes an innovative boot cover. Although originally designed for an ice skating boot, the concept can be applied to other footwear where warmth, or footwear protection, or abrasion resistance is required or desired. Due to a novel, innovative design, unlike currently available ice skate boot covers, application of the cover to the skate does not require the user to remove the skate beforehand. The inventive covers are able to be put on and taken off with the footwear already being worn. In an embodiment of the invention, the novel wrapping configuration of the device is also adjustable and allows a single size device to be used for multiple sizes of skates. The cover also protects the outside covering of footwear, such as an ice skate, which is often scratched, scuffed and abraded by use—for example by ice skaters practicing their skating movements. Although the description and figures refer to and illustrate covers for skates, embodiments of the present invention may be adapted for use with other types of footwear.

This invention also solves the problem of protecting footwear from abrasions by providing an improved covering device. Although footwear covers are not new, this invention is novel and has several advantages over what currently exists.

The most common skate and boot covers are made from thin stretchable material known as spandex or double knit . . . and they introduce 2 problems to the skater. If the skates are already on, that type of cover requires the skater to remove their skate to put the cover above the skate over their ankle prior to putting on the skate. Also, the thin, spandex material gets wet, is easily damaged and does not adequately protect the skate boot. With a pair of figure skates costing from $150 to well over $1500, skaters have an incentive to protect them as long as possible.

The skate covers of the present invention are easily adjusted for normal roller skates—double truck skates, inline skates, "pic-skates", etc. These other types of footwear do not all normally involve cold weather situations, but other advantages of the present invention would also apply, such as resolving the abrasion issues.

An embodiment of the present invention improves the current popular skate cover by incorporating a more robust and insulated hydrophobic material, is designed to be able to be put on without removing the underlying footwear (skate) first, and includes a wrapping configuration that secures the cover to the footwear, and optionally includes a reinforced toe area cover that will serve to protect the most vulnerable parts of the footwear (skate). This protects the footwear, while insulating the footwear.

FIG. 1 illustrates a pair of ice skates wrapped with an embodiment of footwear covers 100 of the present invention. The covers 100 include a front upper portion 101, a wrap section 102 over the arch area of the skate, and a front section 103. Inside and outside surfaces of the covers 100 are represented by 104 and 105, respectively. Secured to the inside surface of one end of the arch wrap section 102 is first fastener 106 and secured to a corresponding tab portion 116 of the outside surface of the cover 100 at the outer arch area is a second fastener 107, mateable with the first fastener 106. Similarly, secured to an outer lower foot flap 108 on the inner arch side of the cover 100 (that is, the right side of the cover 100 of the right skate and the left side of the cover 100 of the left skate) is a third fastener 109 that is mateable with a fourth fastener 113 on the outside surface of an inner lower foot flap 112 on the inner arch side of the arch wrap section 102 (that is, the left side of the cover 100 of the right skate and the right side of the cover 100 of the left skate). The fourth fastener 113 also mates with a fifth fastener 212 (also shown in FIG. 2). Thus, with the outer lower foot flap 108 mating with the inner lower foot flap 112 on the underside 110 of the skate and the fourth fastener 113 mating with the fifth fastener 212, the covers 100 are held securely to the skates. The covers 100 optionally includes a protective toe area 111 and one or more areas 114 for graphics or identifying marks.

If desired, a pocket 115 may be secured, such as by sewing, into the inside surface 104 of the front section 103 to hold a heat pack as a toe warmer.

Figure 2:
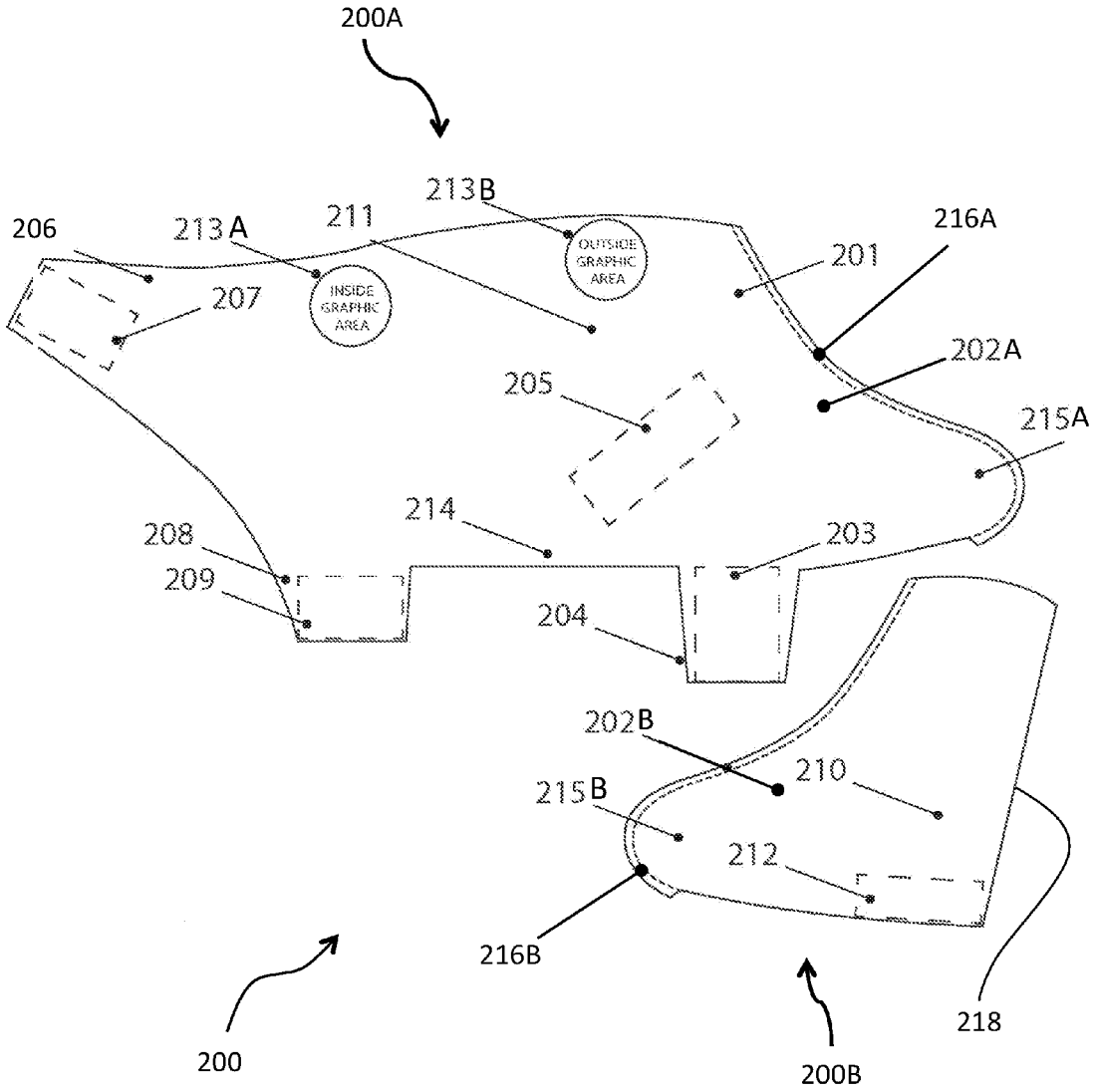
FIG. 2 illustrates a cutting pattern of the footwear cover of FIG. 1.

FIG. 2 illustrates a cutting pattern 200 of the footwear cover 100. The pattern 200 includes a main section 200A and a smaller front section 200B. The main section 200A includes a front upper portion 201, a front portion 202A, as well as inside and outside surfaces 210, 211, respectively. Secured to an outer lower foot flap 204 on the outer arch side of the cover 200 is a first fastener 203 that is mateable with a second fastener 209 on the outside surface of an inner lower foot flap 208 on the inner arch side of the arch wrap section 206. Similarly, secured to the inside surface of one end of the arch wrap section 206 is third fastener 207 and secured to a corresponding portion of the outside surface of the cover 200 at the outer arch area is a fourth fastener 205, mateable with the third fastener 207. Thus, the outer lower foot flap 204 mates with the inner lower foot flap 208 on the underside 214 of the skate. The cover 200 optionally includes a protect toe area 215A and one or more areas 213A, 213B for graphics or identifying marks.

The smaller front section 200B includes a front portion 202B and, optionally, a protected toe area 215B, The outside surface 210 (also indicated in FIG. 1) is made preferably of a lower friction material than the inside surface. To assemble the cover 100, the main section 200A and the smaller front section 200B are sewn together along the edges 216A, 216B (indicated by 216 in FIG. 1; the back edge 218 of the smaller front section 200B is indicated in FIG. 1 as the dotted line 218). As a result, a pocket is formed into which the user's boot will be inserted. When the cover 100 is wrapped over the boot, a fastener 212 (also indicated in FIG. 1) will mate with the fastener 205 on the main section 200A.

Figure 3:
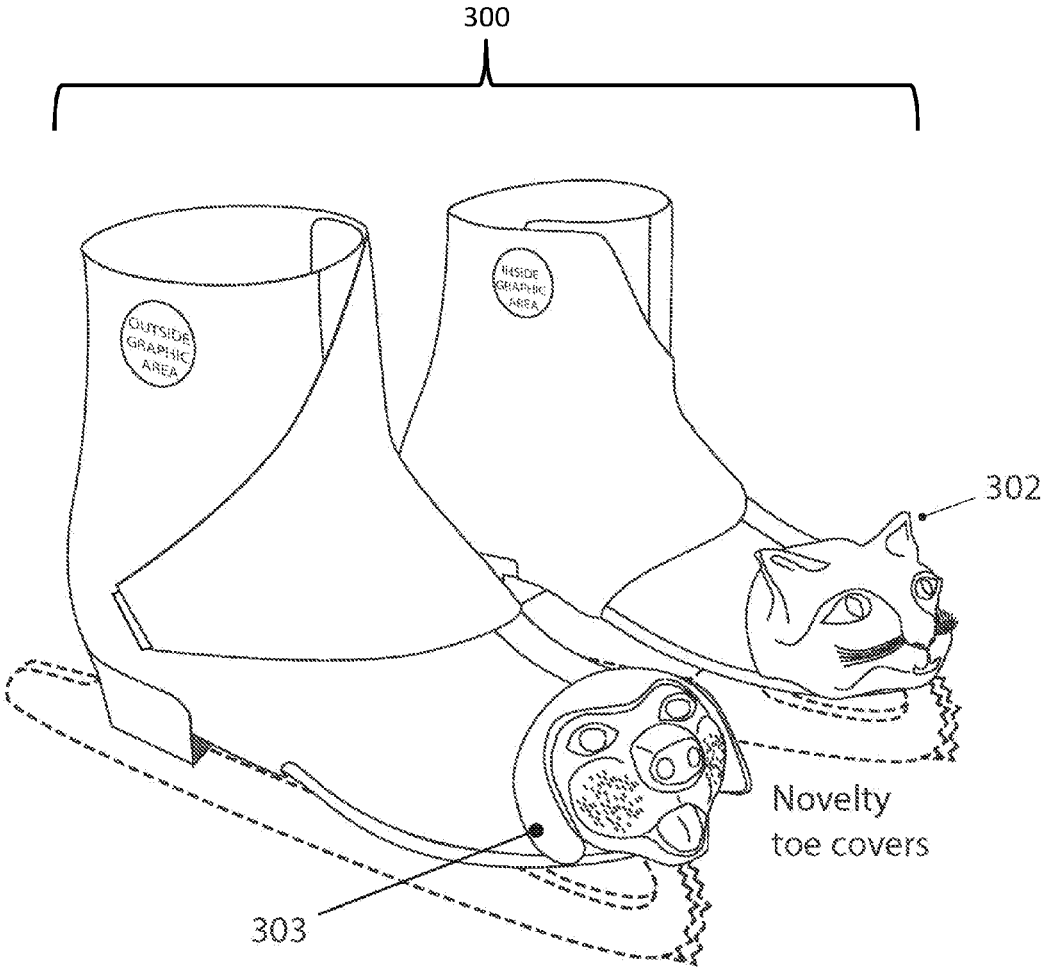
FIG. 3 illustrates an embodiment of footwear cover of the present invention with physical toe elements.

The inventive cover may optionally have a special cap or covering on the toe area that allows further resistance to abrasions by either the other foot or other outside obstacles to the device and footwear. It may or may not include graphic or physical elements that are included on this toe cover that distinguish it from other similar footwear covers. This would not be limited to printed elements, but might include physical conformation that would identify the product as well. FIG. 3 illustrates a pair of covers 300 with physical, three-dimensional elements 303, 302, respectively, on the toe areas.

Figure 4A:
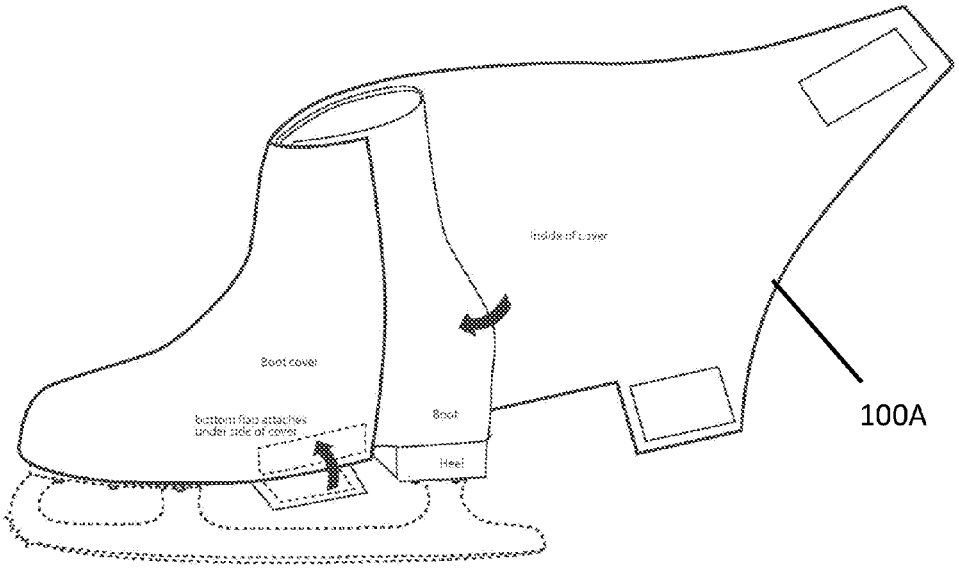
FIG. 4A illustrates a first step in wrapping the footwear cover of FIG. 1 onto an ice skate.
Figure 4B:
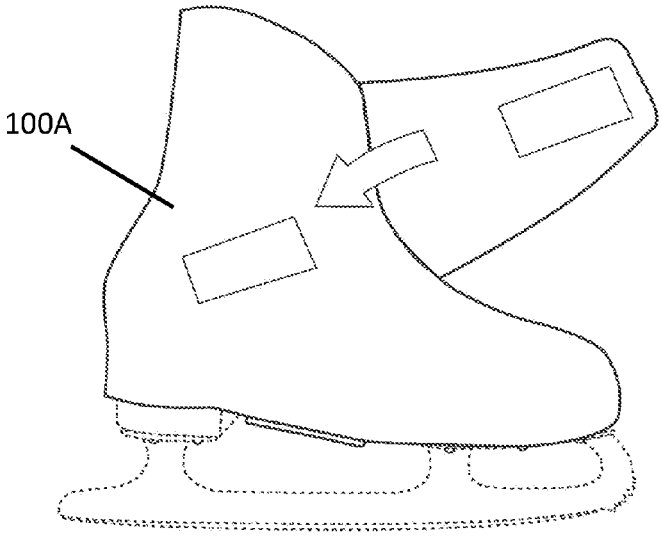
FIG. 4B illustrates a second step in wrapping the footwear cover of FIG. 1 onto an ice skate.
Figure 4C:
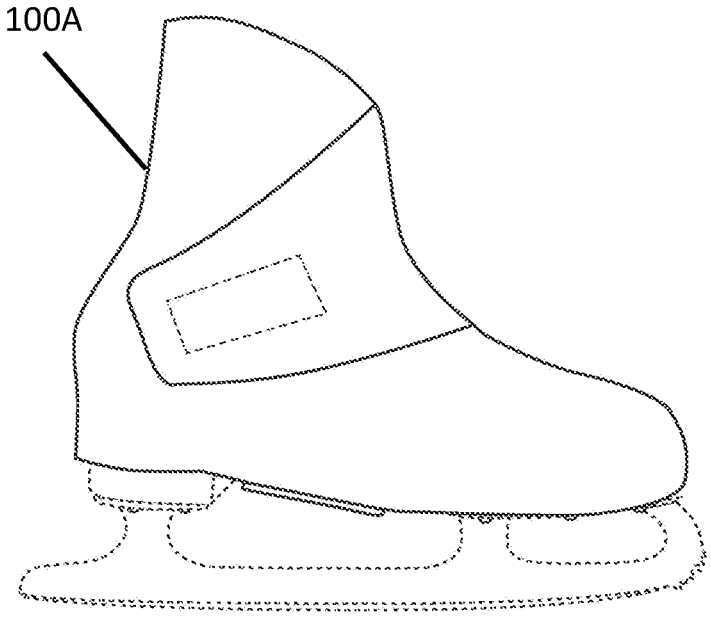
FIG. 4C illustrates a final step in wrapping the footwear cover of FIG. 1 onto an ice skate.
Figure 4D:
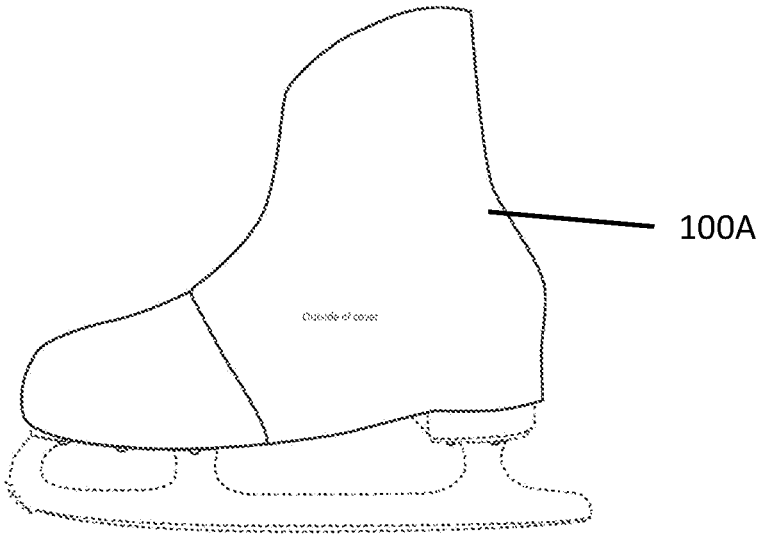
FIG. 4D illustrates the opposite side of the covered ice skate of FIG. 4C.
Figure 4E:
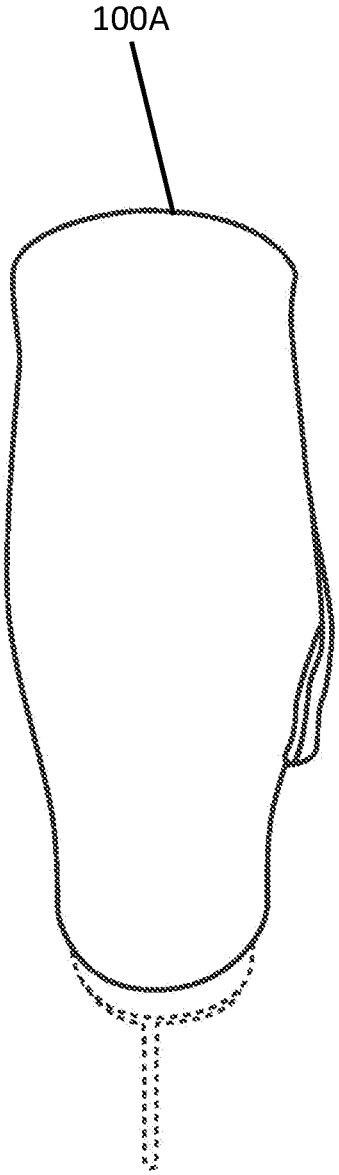
FIG. 4E illustrates a back view of the covered ice skate of FIG. 4C.
Figure 4F:
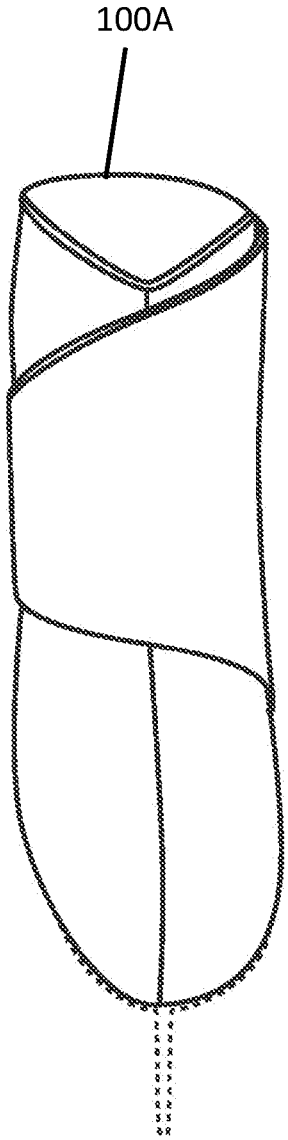
FIG. 4F illustrates a front view of the covered ice skate of FIG. 4C.

FIG. 4A-4C illustrate a process of wrapping a skate with a cover 100 of the present invention. The front 103 of the cover 100 is placed over the toe area of the skate and the remaining portion of the cover is pulled towards the back of the skate. The tab 108 is pulled under the bottom 110 of the skate and the fastener 109 is secured to the corresponding fastener 212 on the other side of the cover 100. The back portion of the cover is then wrapped around the back of the skate and the fastener 113 on the tab 112 is also secured to the fastener 212. The end of the cover 100 is continued to be wrapped around the arch area of the skate and onto the other side, where the fastener 106 is secured to the corresponding fastener 107 on the outer surface 105 of the cover (FIG. 4B). FIG. 4C illustrates the cover 100 completely securely wrapped around the skate. FIG. 4D illustrates the wrapped cover 100 with a protective toe area 111. FIGS. 4E and 4F are back and front views, respectively, of the wrapped skate.

The wrap configuration which goes over the arch of the footwear allows the device to be tightly adjusted around the footwear, eliminates the possibility of extra material from the cover 100 to be caught on outside obstacles or the other foot of the wearer. The location of the attachment area is slightly to the outside of the wearer's footwear, protecting it from being entangled with outside obstacles or the other foot of the wearer The boot cover 100 is designed to include tabs 108, 112 of material that meet under the boot arch 110 where they can be attached to each other and secure the cover 100 to the boot. The cover 100 may also be configured to have an attachment flap 102 that wraps over the arch of the boot, therefore causing the cover 100 to be adjustable in fit based on varied boot shapes and sizes, and also causes the boot cover 100 to be held tightly against the boot to avoid having other outside materials or even the other foot from getting caught on the boot cover. This "wrap over the arch" feature is also unique to the invention.

In one embodiment of the invention, the tabs 108, 112, 106, 107 are removeably attached to each other using a hook-and-loop material, such as Velcro® strips or patches. It is appreciated that those of ordinary skill in the material and footwear accessary arts will understand that the use of Velcro™ material for attaching may be substituted by the use of any suitable fastener, including but not limited to buttons, snaps, hooks and eyes, and the like, without limitation.

Footwear covers of the present invention thus provides several advantages over the prior art, such as but not limited to:

The general configuration of the footwear covers allows them to be applied to the foot and the footwear while the footwear is already being worn, rather than having to remove the footwear from the foot, then apply the covers to the wearer's leg or to the outside of the footwear, and then putting the footwear back on the foot in order to use the protective covers.

The device uses a specific configuration and particular materials that allow for increased insulation properties to be enjoyed by the wearer, therefore increasing comfort and the amount of time that the wearer can comfortably use the footwear concurrently. In various embodiments, the material used may be neoprene, Kevlar® fiber, woven carbon fiber cloth, aramid, silicone, urethane based casting materials, nylon and polyester materials, or the like, without limitation.

Optionally, the inventive device utilizes a material that has a higher coefficient of friction on the inside surface 104 than the outside surface 105, allowing the cover to resist slipping off of the footwear. This allows the covers to be initially applied correctly to the footwear as well as causing the cover to resist slipping off or moving significantly during application and use.

Also in a preferred embodiment, the inventive device utilizes a material that has a lower coefficient of friction on the outside surface 105 than the inside surface 104 allowing the cover to resist abrasions, scuffing and impingement of either the other foot or other outside obstacles to the device and footwear. This allows the footwear to be used in situations where abrasion to the covered footwear is reduced significantly.

The area over the instep of the footwear is covered with a wrapping of cover material that allows the device to be attached to the footwear in the closest configuration possible while remaining fully adjustable, thus eliminating the possibility of the cover bulging or moving away from the footwear and being interfered with or being removed inadvertently by either the other foot, or some other obstacle or impingement.

There are optionally a number of attachment points that make the cover adjustable and able to be utilized over a wide range of footwear configurations and sizes. These attachment points would be connected by various methods including but not limited to hook-and-loop fasteners, snaps, eyelets, so-called notch and clip straps, Saris clips or any other variable attachment devices that are either existing now or in the future.

The various envisioned configurations and use of additional self adjusting materials at the bottom of the device also allows it to be utilized with a wide range of footwear configurations and sizes, and provides a snug fit ensuring conformity and further insulating the footwear from the outside elements.

Because of the materials used and the configuration of the device, the user may also custom fit how the device is worn to affect the outside configuration of the footwear cover. This custom configuration can reduce the possibility of any part of the original footwear to become entangled with outside obstacles, as well as helping the footwear to become more aerodynamic for the user concerned with airflow around the footwear, and also appear visually more streamlined and appealing to the wearer.

The first of two major attachment points 109, 113 for the cover 100 are preferably configured to be under the arch 110 of the footwear and allow the cover 100 to be adjusted and registered to the footwear in two separate places so that the rest of the cover 100 can be fitted to a wide range of footwear. These first attachment points 109, 113 of the device are joined to each other under the arch 110 of the footwear, and in front of the inside of the heel area, and that attachment allows for correct and positive contact with the footwear. This also allows the cover 100 attachment points 109, 113 to be unencumbered and sheltered from inadvertent disconnection and/or removal due to being touched by the other foot, or some other outside obstacle.

In an embodiment of the invention, the second of the two major attachment points 106, 107 are configured to the outside of the wearers footwear and is located slightly over the arch area 102 of the footwear as this is considered to be the safest and least likely area to be interfered with by either the other foot or some outside obstacle as this is directly over the area where the footwear is used to step. The motion of raising and lowering each foot allows this place to be the most sheltered from hitting another object and thus protects the attachment point from becoming loose or detached.

The location of and configuration of the device's identifying product marks and logo marks 114 allow the wearer to identify the device specifically while aiding in understanding the correct way to apply the device to the footwear.

The present invention also provides for several opportunities for monetization. For example, the footwear covers may simply be sold or rented to the user for a price. Alternatively, the exterior visible surface of the covers may be imprinted with a logo or advertising copy, and the cover may be sold, rented or provided for free to the users, with the advertiser charged a fee for printing and/or providing the cover. In another alternative, the user may select a design or message to be applied to the cover for a fee.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A footwear cover, comprising:

an inside surface;

an outside surface;

a front end;

a back edge;

a lower edge;

front edge;

a toe area at the front end;

a first tab (108) extending from the lower edge;

a second tab (112), spaced apart from the first tab, extending from the lower edge;

a third tab (116) extending from the front edge;

a first fastener (109) secured to the inside surface of the first tab (108);

a second fastener (113) secured to the outside surface of the second tab (112);

a third fastener (106) secured to the inside surface of the third tab (116);

a fourth fastener (107) secured to the outside surface of the cover above the first tab (108); and a fifth fastener (212) secured to the outside surface of the cover at a corner of the lower edge and the front edge;

wherein, when the cover is wrapped around a footwear:

the first fastener (109) is configured to mate with the second fastener (113) under the footwear;

the third fastener (106) is configured to mate with the fourth fastener (107) across the upper arch of the footwear; and the fifth fastener (212) is configured to mate with the second fastener (113) under the footwear.

2. The footwear cover of claim 1, further comprising a pocket secured to the inside surface of the toe area.

3. The footwear cover of claim 1, further comprising a protective covering over the toe area.

4. The footwear cover of claim 1, wherein:

the inside surface comprises a first material having a first coefficient of friction; and the outside surface comprises a second material having a second coefficient of friction, lower than the coefficient of the first material.

5. The footwear cover of claim 4, wherein the first and second materials are selected from the group consisting of neoprene, woven carbon fiber cloth, aramid, silicone, urethane-based, nylon, and polyester.

6. The footwear cover of claim 5, wherein the first, second, third, fourth, and fifth fasteners comprise a hook-and-loop material.

7. The footwear cover of claim 1, further comprising a three-dimensional element secured to the toe area.

* * * * *